United States Patent [19]

Wijma

[11] Patent Number: 4,807,359

[45] Date of Patent: Feb. 28, 1989

[54] DRY-SHAVING APPARATUS

[75] Inventor: Willem S. Wijma, Drachten, Netherlands

[73] Assignee: U.S. Philips Corp., New York, N.Y.

[21] Appl. No.: 943,472

[22] Filed: Dec. 16, 1986

[30] Foreign Application Priority Data

May 22, 1986 [NL] Netherlands ..... 8601295

[51] Int. Cl.[4] ..... B26B 19/14

[52] U.S. Cl. ..... 30/43.6; 30/346.51

[58] Field of Search ..... 30/43.6, 43.5, 43.4, 30/43.9, 43.42, 346.51

[56] References Cited

U.S. PATENT DOCUMENTS 3,390,454 7/1968 Godefroy ..... 30/346.51

FOREIGN PATENT DOCUMENTS 434387 1/1975 U.S.S.R. ..... 30/43.6

*Primary Examiner*—Douglas D. Watts

*Attorney, Agent, or Firm*—Ernestine C. Bartlett

[57] ABSTRACT

A dry-shaving apparatus comprising a housing supporting a cutter for rotation is provided in which the cutting elements of a rotatable cutter follow a constrained path defined by the shear plate and, when the elements are clear of the shear plate, follow a free path in the form of a first circular arc as part of a revolution during rotation of the cutter. The shear plate includes peripheral portions wherein the first peripheral portion is proximate to the point where the free path changes into the constrained path and the second peripheral portion is proximate to the point where the constrained path changes into the free path, the peripheral portions adjoining the housing and a central portion which in a sectional view transverse to the axis of rotation to the cutter is curved in conformity with a second circular arc which is concentric with the first circular arc and in which the centers of the two circular arcs coincide but in which the radius of the second circular arc is smaller than the radius of the first circular arc.

To avoid collision, undesired vibrations and damage to parts during the change from the free path to the constrained path, the shear plate also comprises a curved transition portion adjoining the first peripheral portion and the central portion which is given a curved shape with a radius of curvature larger than the radius of curvature of the central portion.

2 Claims, 2 Drawing Sheets

DRY-SHAVING APPARATUS

The invention relates to a dry shaving apparatus comprising a housing with a holder for a shear plate formed with hair-entry apertures. A cutter is rotatable about an axis of rotation, which cutter comprises a carrier with cutting elements which are movable in a substantially radial direction relative to the carrier. The cutting elements comprise cutting edges at their radial ends, each point of a cutting edge of a cutting element following a constrained path defined by the shear plate and, when the cutting edges are clear of the shear plate, a free path in form of a first circular arc as part of a revolution during rotation of the rotatable cutter. The shear plate includes peripheral portions where the shear plate adjoins the holder. A first peripheral portion is in proximity to where the free path changes into the constrained path and a second peripheral portion is in proximity to where the constrained path changes into the free path.

Such a dry shaving apparatus is known, for example from U.S. Pat. No. 3,710,442. When in the known apparatus the cutting edges of the cutter change over from the free path to the constrained path the sudden contact between the cutting elements and the shear plate will produce undesired vibrations in the cutter, which may give rise to damage to this cutter, the shear plate and other parts of the apparatus.

SUMMARY OF INVENTION

It is the object of the present invention to mitigate this problem and to this end the invention is characterized in that the shear plate comprises a central portion which in a sectional view transverse to the axis of rotation is curved in conformity with a second circular arc. The second circular arc is concentric with the first circular arc which has a smaller radius than the first circular arc and which defines a corresponding circularly arcuate part of the constrainted path. A curved transitional portion having a larger radius of curvature than the central portion is provided between the central portion and the first peripheral portion of the shear plate.

An embodiment of the invention will now be described in more detail, by way of example, with reference to the accompanying drawings.

DESCRIPTION OF THE PREFERRED EMBODIMENT

Figure 1:
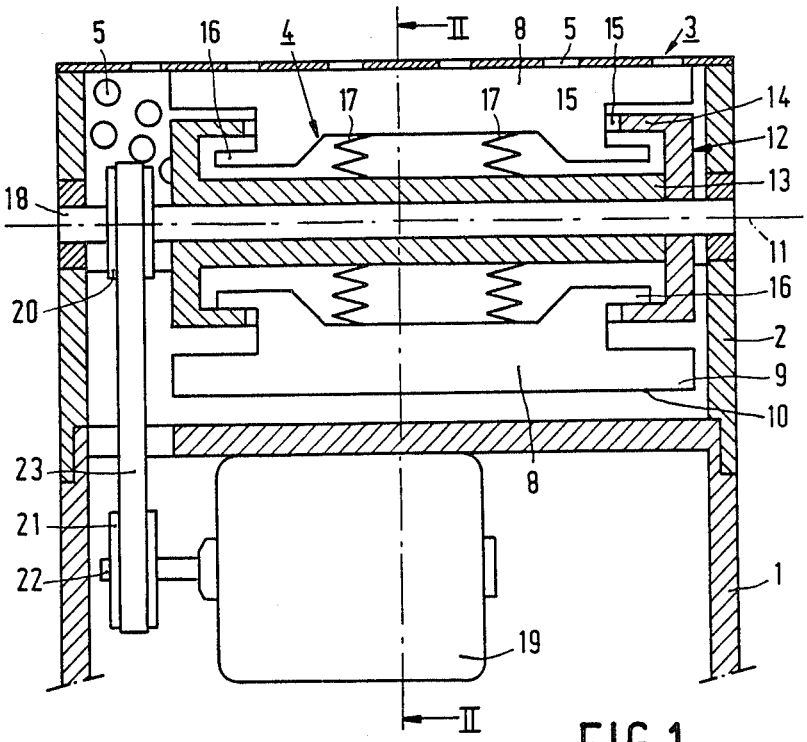
FIG. 1 is a schematic a longitudinal sectional view of schematic a dry-shaving apparaus in accordance with the invention.
Figure 2:
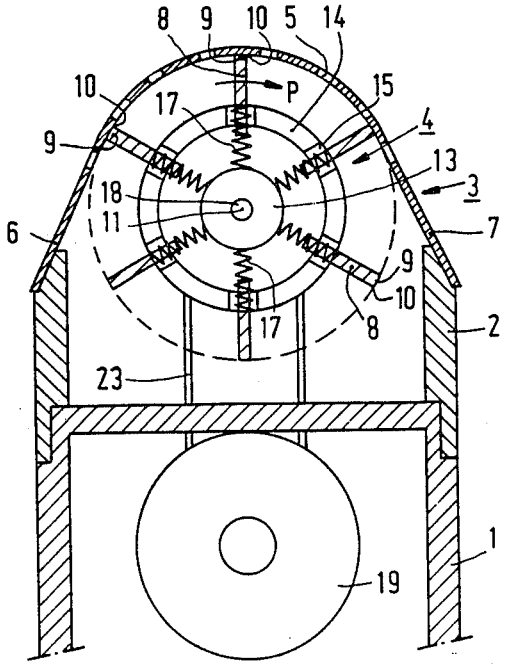
FIG. 2 is a sectional view taken on the line II—II in FIG. 1.

The dry-shaving apparatus shown in FIGS. 1 and 2 comprises a housing 1 with a holder 2 for a shear plate 3 and a cutter 4 which is rotatable relative to the shear plate.

The shear plate 3 is formed with hair-entry apertures 5 and comprises a first peripheral portion 6 and a second peripheral portion 7 by which the shear plate is secured to the holder 2.

The cutter 4 comprises cutting elements 8 having cutting edges 10 at their radial ends 9. The cutter 4 is supported in the holder 2 so as to be rotatable about the axis of rotation 11 and partly adjoins the shear plate 3. Hairs which project inwards through the hair entry apertures 5 can now be severed by cooperation between the shear plate 3 and the cutting edges 10 of the cutting elements 8, which cutting edges slide along the inner side of the shear plate.

The cutter 4 comprises a carrier 12 for the cutting elements 8, which carrier comprises a hub 13 and a cylindrical portion 14 with slots 15. The cutting elements 8 extend partly within the slots 15 and are radially movable relative to the carrier over a limited distance. The hook-shaped ends 16 of the cutting elements are situated between the hub 13 and the cylindrical portion 14 and prevent the cutting elements 8 from falling out of the carrier 12. Pressure springs 17 are arranged betwen the hub 13 and the cutting elements 8 to exert outwardly directed radial forces on the cutting elements 8.

The hub 13 is secured to the shaft 18 which is supported in the holder 2 so as to be rotatable about the axis of rotation 11. The electric motor 19 for driving the cutter 4, for example in a direction of rotation as indicated by the arrow P (FIG. 2), is mounted inside the housing 1. The rotation of motor 19 is transmitted to the cutter 4 by means of pulleys 20 and 21 on the shaft 18 and the motor shaft 22 respectively and the drive belt 23.

Figure 3:
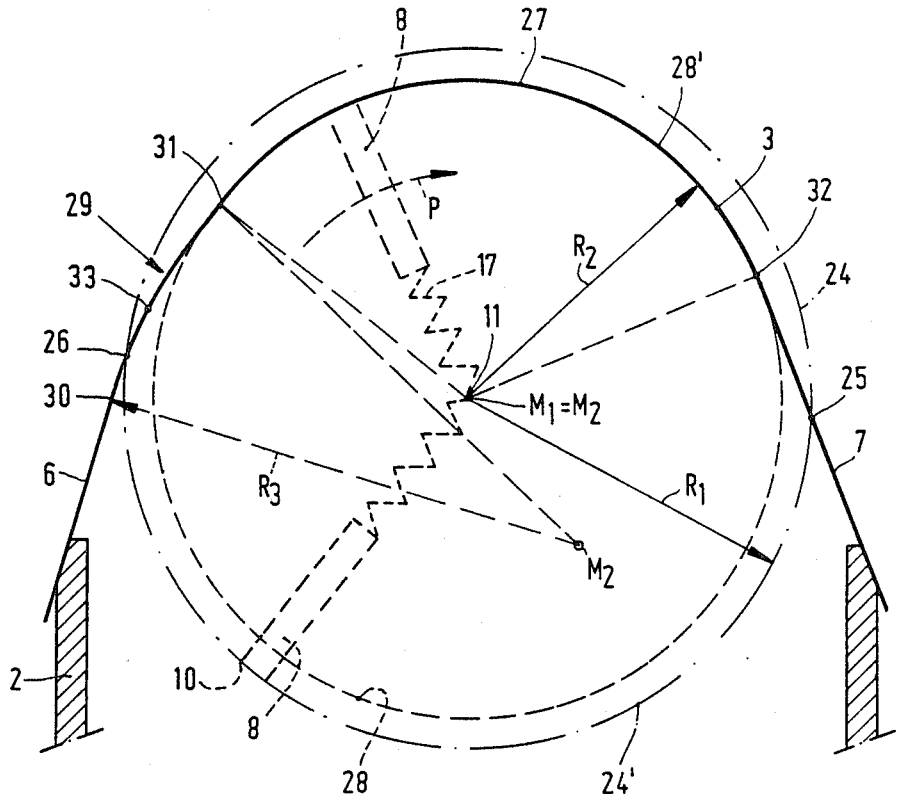
FIG. 3 is an enlarged-scale simplified sectional view similar to FIG. 2.

FIG. 3 shows a cross-sectional view similar to FIG. 2 in simplified form and to an enlarged scale and shows schematically the shear plate 3 which is secured to the holder 2. The broken lines indicate two cutting elements 8.

If the cutting elements 8 of the cutter 4 are not subjected to forces other than those exerted by the pressure springs 17, inertial forces being ignored, the springs 17 will urge the cutting elements 8 as far outwards as possible relative to the carrier 12, causing the hook-shaped ends 16 to engage against the cylindrical portion 14 (see also FIG. 1). As the cutter 4 rotates about the axis of rotation 11 the path followed by the cutting edges 10 at the ends 9 of the cutting elements may be defined in this situation as a cylindrical path which in a sectional view as shown in FIG. 3 may be represented as a circle 24 having a centre $M_1$ and a radius $R_1$.

The circle 24 intersects the shear plate 3 in points 25 and 26. A point of a cutting edge 11 consequently follows a free path having the shape of a first circular arc 24' which forms part of the circle 24 and which extends from 25 to 26 in the direction of rotation P. In point 26 the free path changes into a constrained path which is defined by the shear plate 3 and which extends up to point 25.

The shear plate comprises a central portion 27 which is shown in FIG. 3 in a sectional view transverse to the axis of rotation 11 is curved in conformity with a second circular arc 28' which is concentric with the first arc of circle 24'. The radius $R_2$ of the second circular arc 28', however, is smaller than the radius $R_1$ of the first circular arc 24'. The second circular arc 28' forms part of a circle 28 having a centre $M_2$ which coincides with the centre $M_1$. In theory the two centres $M_1$ and $M_2$ are situated on the axis of rotation 11.

Between the central portion 27 and the first peripheral portion 6 the shear plate 3 comprises a curved transitional portion 29 on which the point 26 is situated. In points 30 and 31 the transitional portion 29 adjoins the first peripheral portion 6 and the central portion 27, respectively. In point 32 the central portion 27 adjoins the second peripheral portion 7. Since the centres $M_1$ and $M_2$ of the circles 24 and 28 coincide but the radius $R_1$ of the circle 24 is larger than the radius $R_2$ of the circle 28 the springs 17 will be compressed over a constant length as a point of a cutting edge 10 follows the second circular arc 28'. When this part 28' of the constrained path is followed the cutting elements 8 are therefore urged against the inner side of the shear plate 3 with constant pressure.

After the free path a cutting edge 10 of a cutting element 8 will come into contact with the shear plate 3 at point 26. This sudden contact may be regarded as a collision between a cutting element and the shear plate, which may give rise to vibrations which may lead to a degraded performance of the apparaus and which may lead to damage. Moreover, these collisions may produce substantial forces between the shear plate and the cutting element, which may also give rise to damage. Such large forces may occur in particular if the cutting elements 8 are mounted in the carrier 12 (FIG. 1) in a self-locking or self-biasing manner, which are customary techniques used in dry shavers.

It is found to be very important that the transition from the free path to the constrained path proceeds as uniformly as possible in order to mitigate the aforementioned collision effects and undesirable consequences thereof.

For this purpose the transitional portion 29 is given a curved shape with a radius of curvature larger than the radius $R_2$ of the central portion 27. The radius of curvature may, for example, decrease continuously from point 30 towards point 31, the radius of curvature in point 26 being substantially equal to the value of $R_1$ and that in point 31 being substantially equal to the value of $R_2$. In this way a smooth transition from the free path to the constrained path can be obtained for a cutting edge 10, the cutting element being urged inwards constantly until the central portion 27 is reached.

Alternatively, the transitional portion 29 may be constructed in such a way that in a sectional view transverse to the axis of rotation 11 it is curved in conformity with a third circular arc 33 having a centre $M_3$ and a radius $R_3$ larger than $R_2$ as is shown in FIG. 3.

If $M_3$ is selected to be situated on the diameter of the circle 28 through $M_1$ and point 31 where the transitional portion 29 and the central portion 27 adjoin each other, it is also possible to obtain a gradual transition at point 31 between these two portions.

Thus, there is described a dry shaver which has means for reducing vibrations between a cutter and shear plate.

What is claimed is:

1. A dry shaving apparatus comprising:

a housing;

a cutter supported for rotation in said housing, said cutter including a plurality of radial cutting elements supported on a carrier for radial movement, said cutting elements having cutting edges at their ends which when fully extended define a first circular arc; and a shear plate supported by said housing having first and second peripheral portions adjoining said housing; a central portion curved to conform with a second circular arc concentric with said cutter axis and having a radius smaller than the radius of said first circular arc; and a transitional portion curved to have a radius greater than he radius of the second circular arc; said shear plate forming a constrained path for the ends of said cutting elements, adjacent a free path where said radial elements fully extend, said transition portion providing between said first peripheral portion and said central portion a transition path to said free path for said radial cutting elements, whereby said radial elements enter and leave said transitional path reducing the effects of collisions between said radial cutting elements and said shear plate.

2. A dry-shaving apparatus as claimed in claim 1 wherein the transitional portion is curved in conformity with a third circular arc having a larger radius than the first circular arc.

* * * * *